United States Patent [19]

Maksim, Jr.

[11] 4,411,617

[45] Oct. 25, 1983

[54] BURNERS FOR SOAKING PIT FURNACES

[76] Inventor: John Maksim, Jr., 8165 Cornwall Ave., Etiwanda, Calif. 91739

[21] Appl. No.: 293,387

[22] Filed: Aug. 17, 1981

Related U.S. Application Data

[63] Continuation of Ser. No. 146,469, May 5, 1980, abandoned, which is a continuation of Ser. No. 850,235, Nov. 10, 1977, abandoned.

[51] Int. Cl.[3] ..... F23C 7/00

[52] U.S. Cl. ..... 431/187; 431/8; 431/181; 432/120

[58] Field of Search ..... 431/187, 181, 284, 285, 431/8; 432/193, 194, 120

[56] References Cited

U.S. PATENT DOCUMENTS

| | | | |
|---|---|---|---|
| 2,480,258 | 8/1949 | Mortson et al. | 431/187 |
| 2,834,407 | 5/1958 | Mason | 431/284 X |
| 3,174,527 | 3/1965 | Reed et al. | 431/187 |
| 3,209,808 | 10/1965 | Conway et al. | 432/193 X |
| 3,217,779 | 11/1965 | Reed et al. | 431/285 |
| 3,411,761 | 11/1968 | Gmell | 431/173 X |

*Primary Examiner*—Edward G. Favors

*Attorney, Agent, or Firm*—Christie, Parker & Hale

[57] ABSTRACT

A burner for soaking pit furnaces produces essentially complete combustion of the gas and air mixed in the burner. The burner includes a tubular inner wall structure and an outer housing spaced from the inner wall to form a hollow interior between the inner wall and the housing. The inner wall terminates adjacent a surrounding portion of the housing to form a narrow opening from the hollow interior which extends around the periphery of the inner wall structure. A gas supply pipe located in the hollow interior surrounds the inner wall structure and directs the flow of gas under pressure toward the narrow peripheral opening. In one embodiment, the inner wall forms an air supply pipe and air is forced under pressure through the air supply pipe and past the narrow opening. Gas flowing through the narrow opening surrounds and is drawn into air flowing past the opening to form a combustible gas/air mixture. In another embodiment, air under pressure is introduced to the hollow interior where it mixes completely with the gas to form a combustible gas/air mixture which is forced under pressure through the narrow opening. In both instances, a clean-burning, continuous blue flame is produced in the soaking pit.

21 Claims, 3 Drawing Figures

BURNERS FOR SOAKING PIT FURNACES

CROSS REFERENCE TO RELATED APPLICATIONS

This is a continuation of application Ser. No. 146,469, filed May 5, 1980, now abandoned which is a continuation of application Ser. No. 850,235, filed Nov. 10, 1977, now abandoned.

BACKGROUND

This invention relates to burners for soaking pit furnaces for steel mills and the like. More particularly, the invention relates to an improvement in a bottom-fired soaking pit furnace in which one centrally located burner extends through the floor of the soaking pit and directs the flame upwardly into the interior of the soaking pit furnace.

Steel ingots produced in steel mills are placed in a soaking pit furnace for heating the ingots to a temperature of about 2400° F. The heated ingots soak at that temperature to uniformly heat them throughout until they are malleable enough to be rolled. In a commonly used soaking pit having a prior art burner, it presently takes from about 3 to 4 hours to heat a steel ingot to a temperature of about 2400° F. and another 4 hours or so to soak the ingot to its malleable condition. Such a prior art burner is used in a bottom-fired soaking pit. The burner includes an upright gas pipe disposed centrally in a relatively wide air flow channel which surrounds the gas pipe. Air flows upwardly through the channel and mixes with gas flowing from the pipe. The burner produces a yellow flame, indicating incomplete combustion of the gas and air. The incomplete combustion results in excessive oxide scale buildup on the surface of the steel ingots. The scale acts as an insulator which increases the time and energy required to heat up and soak the steel ingots. Moreover, the scale buildup on the ingots reduces the weight of high grade steel production per ingot. The layer of oxide scale is removed from the ingots after they are soaked and is used in less profitable lower grade steel.

The present invention provides a burner for soaking pits which produces a continuous clean burning blue flame during use. By avoiding incomplete combustion, the burner of this invention reduces scale buildup on the ingots. This results in greater production of more profitable higher grade steel per ingot. The flame produced by the burner of this invention also burns hotter, which reduces the amount of time required for the ingots to reach their soaking temperature, as well as reducing the soaking time of the ingots. The hotter flame also provides a corresponding energy saving because the amount of gas consumption required to heat each ingot is reduced. Inasmuch as scale buildup is reduced, and the scale can act as an insulator, the amount of heat transferred to the ingots by the burner of this invention is increased, which provides an additional saving in heating and soaking time. By reducing soaking time, production can be increased without additional increase in fuel cost. Further, by avoiding incomplete combustion, air pollution is reduced, and the useful life of the soaking pit burner and furnace structure is extended.

SUMMARY OF THE INVENTION

According to one embodiment of this invention, a burner for a soaking it furnace comprises a housing, an air supply pipe extending through the housing and terminating at an end spaced closely apart from an adjacent portion of the housing to form a narrow elongated opening surrounding the periphery of the air supply pipe and located between the end of the air supply pipe and the adjacent portion of the housing. The air supply pipe causes air flowing through it to flow away from the pipe and past the narrow peripheral opening. Gas supply means force gas to flow under pressure through the narrow opening in a direction away from the end of the gas supply pipe so that the gas mixes with air flowing past the narrow opening. This forms a combustible gas/air mixture in which the gas is mixed so well with the air that the mixture, when ignited, produces a continuous clean-burning blue flame.

In another embodiment of the burner, a mixing chamber includes a tubular inner wall structure spaced inwardly from a surrounding outer housing to form a hollow interior space between the inner wall and the outer housing. The inner wall has an end which is spaced closely apart from an adjacent portion of the outer housing to form a narrow elongated annular opening surrounding the periphery of the inner wall. Gas supply means force gas under pressure to flow through the hollow interior of the mixing chamber toward the narrow opening. An air supply means also forces air under pressure through the hollow interior of the mixing chamber where it mixes with the gas flow therein to produce a combustible gas/air mixture which flows out through the narrow opening. The gas and air mix so well within the chamber that the mixture flowing from the narrow opening produces complete combustion, when ignited, resulting in a continuous, clean-burning, blue flame.

These and other aspects of the invention will be more fully understood by referring to the following detailed description and the accompanying drawings.

DRAWINGS

DETAILED DESCRIPTION

Figure 1:
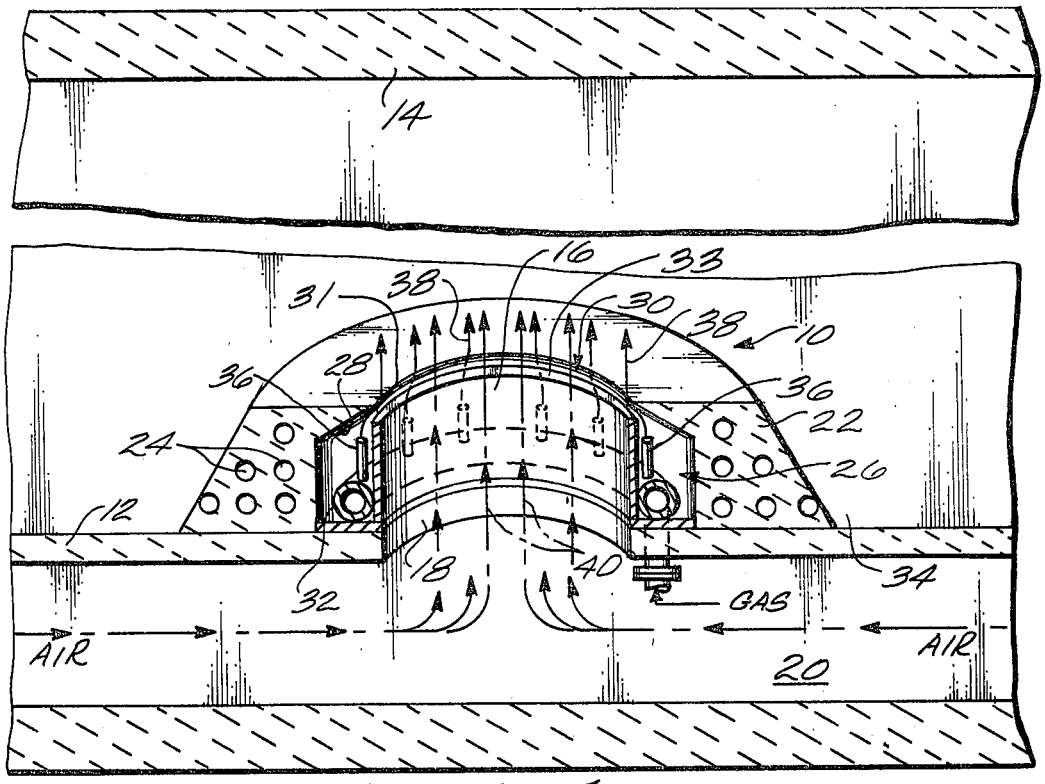
FIG. 1 is a semi-schematic, cross-sectional perspective view showing a soaking pit burner according to one embodiment of this invention, the cross-sectional view being taken on a section line through the center of the burner.

FIG. 1 shows a bottom-fired soaking pit furnace having a single burner 10 extending through a floor 12 of the furnace. The furnace also includes upright side walls (not shown) extending above the floor, and a soaking pit cover 14 above the side walls for forming an enclosure which is fired by a flame produced by the burner 10.

The burner includes an upright tubular, cylindrical air supply pipe 16 extending around a circular opening 18 in the floor 12 of the soaking pit furnace. The air supply pipe 16 is connected to a source of air under pressure flowing through an air tunnel 20 below the soaking pit floor 12. Air flowing in the air tunnel 20 is forced to flow upwardly through the air supply pipe 16.

A ring-shaped housing 22 exceeds above the floor of the soaking pit and surrounds the exterior portion of the air supply pipe 16 which projects above the opening in the soaking pit floor 12. The housing 22 is made from a heat-resistant material such as steel, or a refractory material such as ceramic or brick. The housing can have embedded water cooling pipes illustrated schematically at 24. A major upright portion of the housing interior surface is spaced apart from the exterior wall of the air supply pipe 16 to provide a substantially enclosed annular hollow interior space or chamber 26 surrounding the exterior wall of the air supply pipe 16 above the opening 18.

An upper interior wall portion of the housing tapers inwardly toward the end of the air supply pipe 16 to form an annular baffle 28 located above the chamber 26 and surrounding the upper end portion of the air supply pipe 16. The inside edge 31 of the baffle 28 is spaced apart from the exterior of the air supply pipe 16 to form narrow annular opening 30 at the top of the housing 22. The narrow opening 30 is located immediately adjacent the exterior upper end portion of the air supply pipe and extends entirely around the periphery of the air supply pipe. The narrow opening 30 is located immediately adjacent the outer surface of the air supply pipe, the opening being separated from the inside surface of the air supply pipe 16 solely by the wall thickness of the pipe, which in one embodiment is less than about one inch. The peripheral opening 30 is narrow in relation to the diameter of the air supply pipe. Preferably, the width of the opening is less than about 20% of the diameter of the air supply pipe. In one embodiment, the air supply pipe 16 has an inside diameter of 24 inches, and the width of the narrow opening 30 is in the range of about ½ to about 2 inches.

The baffle portion of the housing 22 covers the top of the hollow chamber 26, and the inside annular edge 31 of the baffle 28 extends above the top edge 33 of the air supply pipe 16 so that the narrow opening 30 is actually formed above the top edge 33 of the air supply pipe. Thus, the narrow opening 30 above the interior of the chamber 26 faces radially inwardly toward the centerline of the air supply pipe 16.

An annular gas supply pipe 32 disposed within the chamber 26 surrounds the exterior wall of the air supply pipe 16. The annular gas supply pipe 32 is connected to a gas line 34 for supplying a source of gas under pressure to the interior of the gas supply pipe 32. The gas supply pipe is located in the bottom portion of the chamber 26, and a plurality of circumferentially spaced apart upright standpipes 36 extend around the top of the gas pipe and are directed generally upwardly toward the narrow opening 30 above the gas supply pipe. In one embodiment, the gas supply pipe 32 has a ring diameter of about 32 inches and an inside diameter of about 4 inches.

In using the burner 10, a fuel such as natural gas or coke oven gas under pressure, preferably about 15 to 20 psi line pressure, is introduced to the gas supply pipe through the gas line 34. The gas flows upwardly through the spaced apart standpipes 36 toward the narrow annular opening 30. The gas flows through a major portion of the chamber 26 prior to flowing out through the opening 30. This produces a laminar, generally uniform cross-sectional flow of gas through the narrow opening 30 generally in the direction of the arrows 38 shown in FIG. 1. Simultaneously, combustion air is forced under pressure, say 15 to 20 psi line pressure, through the air supply pipe 16 in the direction of the arrows 40 shown in FIG. 1. The air flows in an upward laminar stream past the annular narrow opening 30. The baffle 28 reduces the cross-section of gas flow prior to the gas flowing out through the narrow opening 30 and produces a low pressure region of gas flow which aids in continuously and uniformly drawing gas flow through the narrow opening into the air stream flowing past the narrow opening 30, which intimately mixes the gas with the air stream. The gas stream is contiguous with and surrounds the air stream which tends to draw the surrounding flow of gas into it, producing a mixing effect resulting in a combustible gas/air mixture which produces a continuous, clean-burning blue flame when ignited. By generating a low pressure region in the stream of flow above the burner, the flame is constantly self-sustaining. The narrow size of the opening 30 and the gas pressure setting allow the gas to flow out so that the flame produced by the gas flutters, rather than producing more of a gas jet stream which has a tendency to blow out. Moreover, the narrow opening 30 inhibits any tendency for pre-ignition to occur within the chamber 26, and the portion of the baffle 28 which covers the chamber keeps scale and soot from building up in the interior of the chamber or clogging the gas supply pipe. I have learned that by interchanging the gas and air supply, i.e., so that the gas flows through the pipe 16 and air flows through the narrow opening 30, a yellow flame is produced, indicating incomplete combustion.

Figure 2:
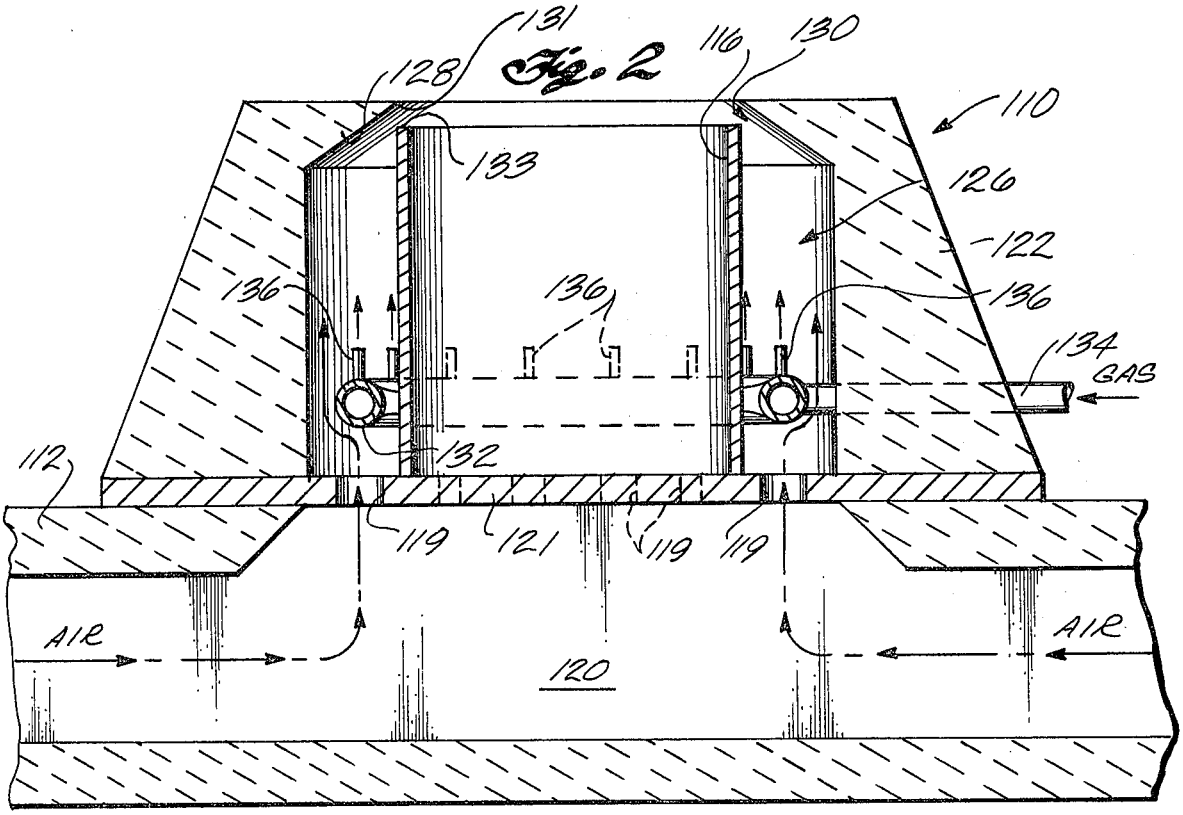
FIG. 2 is a semi-schematic, cross-sectional view showing an alternate form of the burner according to this invention, the cross-sectional view being taken on a section line through the center of the burner.

FIG. 2 illustrates an alternate burner according to this invention in which a ring-shaped outer housing 122, similar to housing 22, surrounds an upright tubular inner wall structure 116 similar to air supply pipe 16. An interior chamber 126 similar to the chamber 16 is formed between the inside of the housing 122 and the exterior surface of the inner wall structure 116. The top of the housing 122 has an inwardly tapering annular baffle 128 similar to the baffle 28, and a narrow annular opening 130 is formed around the periphery of the wall structure 116 similar to the narrow annular opening 30 of the burner shown in FIG. 1.

An air tunnel 120 similar to the air tunnel 20 provides a source of air under pressure; but in the burner of FIG. 2 the air is introduced to the interior of the chamber 126 through a plurality of circumferentially spaced apart air inlet openings 119 which extend from the air tunnel 120 into the lower portion of the chamber 126. The air inlet openings 119 are formed in a plate 121 which rests on top of the floor 112 of the soaking pit. The plate 121, or similar wall structure, closes off the bottom interior portion of the inner wall structure 116 so that air flowing in the air tunnel flows only through the air inlet openings 119 and into the chamber 126. A rotatable plate (not shown) can be superimposed on the plate 121 and rotate registering openings adjacent the openings 119 to provide a means for regulating the pressure of air flowing into the chamber 126. An annular gas supply pipe 132 similar to gas supply pipe 32 is located in chamber 126 above the air inlet openings 119.

The gas supply pipe 132 includes a plurality of circumferentially spaced apart upright standpipes 136 directed generally toward the narrow opening 130. A gas line 134 introduced gas under pressure to the interior of the gas supply pipe 132, and gas is directed from the standpipes 136 through a major portion of the interior chamber 126 and toward the narrow opening 130. Air under pressure forced through the air inlet openings 119 passes around the gas pipe, and mixes with gas flowing through the chamber 126 toward the narrow opening 130. The interior chamber 126 provides a mixing chamber in which the gas and air are mixed, and the narrow opening produces a restriction in the cross-sectional area through which the gas/air mixture flows, resulting in an intimately mixed combustible gas/air mixture flowing through the narrow opening 130. This intimately mixed combustible mixture, when ignited, produces a clean-burning blue flame at the top of the burner.

Figure 3:
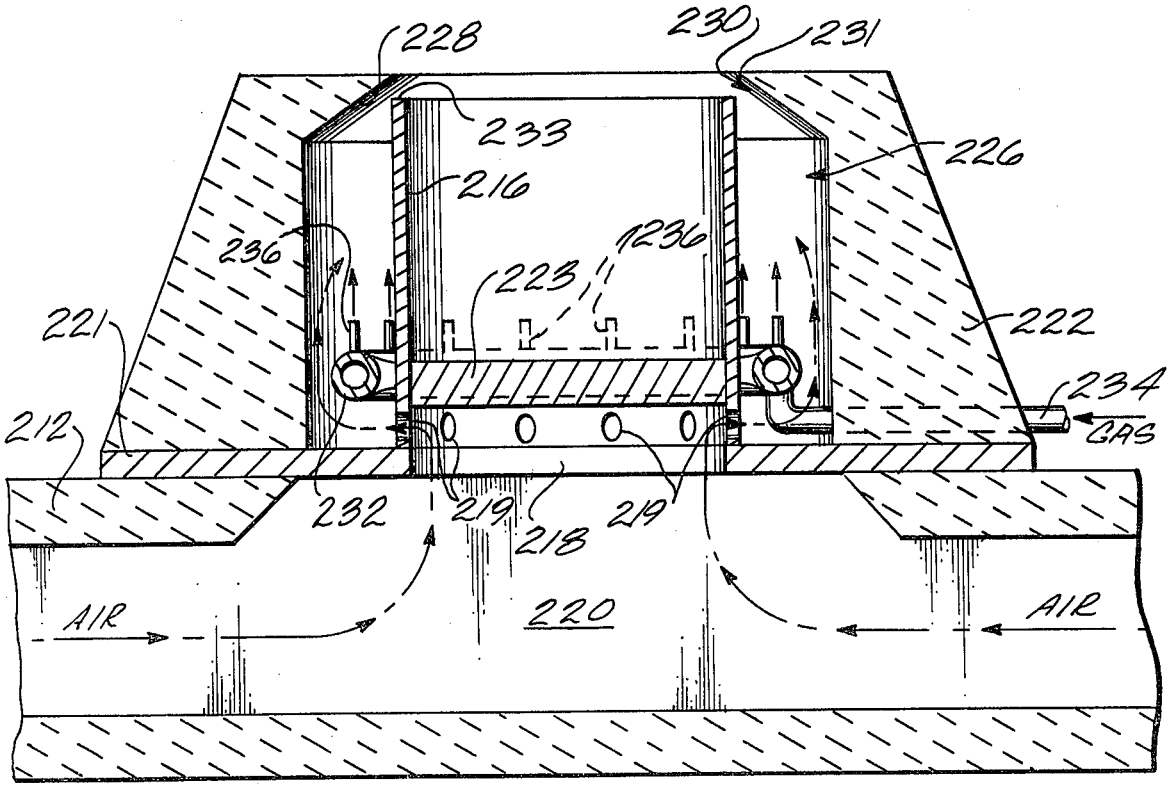
FIG. 3 is a semi-schematic, cross-sectional view showing an alternate form of the burner shown in FIG. 2 and taken on a section line through the center of the burner.

FIG. 3 shows an alternate form of the burner shown in FIG. 2 in which a clean-burning blue flame also is produced. The perforated plate 121 of FIG. 2 is replaced with a plate 221 in FIG. 3 having a central opening 218 for receiving the supply of air from the air tunnel 220. In this instance, the opening through the tubular wall structure 216 has a plug 223 for directing the flow of air through a plurality of circumferentially spaced apart air inlet openings 219 located below the plug and around the lower portion of the wall structure 216. Thus, the flow of air from the air tunnel 220 is directed through the openings 219 and into the chamber 226 where the air mixes with the gas from the gas pipe 232 prior to the gas/air mixture flowing through the opening 230.

What is claimed is:

1. A soaking pit comprising:

a furnace having a floor and an enclosed area above a floor for containing metal ingots to be heated;

an air supply pipe having an upper end spaced above the furnace floor;

an exterior housing surrounding the side wall of the air supply pipe and spaced laterally from the air supply pipe to form an annular hollow interior region between the air supply pipe and the housing, the housing having an upper exterior wall spaced above the furnace floor and defining the top of the burner, said upper exterior wall of the housing being spaced closely apart from the upper end of the air supply pipe to form a narrow annular burner opening atop the burner above said hollow interior region, the burner opening being spaced above the furnace floor at substantially the same elevation as the upper end of the air supply pipe and the upper exterior wall of the housing;

means for supplying air in the substantial absence of fuel to the air supply pipe for causing such air to flow through the pipe and upwardly past the burner opening; and gas supply means for supplying gaseous fuel to said hollow interior region for causing such fuel to flow through said burner opening and into the furnace above the upper end of the air supply pipe and above the upper exterior wall of the housing so that the fuel mixes with the air flowing past said burner opening to form a combustible fuel/air mixture which, when ignited, produces a flame adjacent the upper exterior wall of the housing and the upper end of the air supply pipe.

2. Apparatus according to claim 1 in which the gas supply means comprises a gas supply pipe inside said hollow interior region surrounding the side wall of the air supply pipe, and the gas supply pipe includes means for directing the flow of fuel through the hollow interior region of the housing toward said burner opening.

3. Apparatus according to claim 2 in which said means for directing fuel comprises upright standpipes mutually spaced apart around the gas supply pipe and directed toward the burner opening.

4. Apparatus according to claim 1 in which the housing includes baffle means adjacent the upper end of the air supply pipe for reducing the cross sectional area through which the fuel flows prior to flowing through said burner opening, said baffle means extending over the interior region of the housing.

5. Apparatus according to claim 1 including a supply of air under pressure connected only to the air supply air, and a supply of gaseous fuel under pressure connected only to the gas supply means.

6. Apparatus according to claim 1 in which the gas flowing through the burner opening is separated from air flowing in the air supply pipe esssentially only by the wall thickness of the air supply pipe.

7. Apparatus according to claim 1 in which the air supply means includes an air tunnel connected to a source of air under pressure, and means sealing the hollow interior region of the housing against entry of air from said air tunnel into said hollow interior region, said air supply pipe being open to the flow of air under pressure in the air tunnel, and the gas supply means includes a source of gaseous fuel communnicating with said hollow interior region and sealed against entry into the air supply pipe.

8. Apparatus according to claim 7 in which the gaseous fuel is at about 15 to 20 psi line pressure.

9. A soaking pit for heating ingots comprising:

a furnace having a floor and an enclosed area above the floor of the furnace for containing metal ingots to be heated;

a burner in the furnace, the burner including an inner air supply pipe having an upper end in the enclosed area of the furnace spaced above the furnace floor, and an exterior housing surrounding the side wall of the air supply pipe and spaced laterally from the air supply pipe to form an annular hollow interior region between the air supply pipe and the housing, the housing having an upper exterior wall in the enclosed area of the furnace spaced closely apart from the upper end of the air supply pipe for forming a narrow annular burner opening above said hollow interior region, the upper exterior wall of the housing defining the top of the burner, the burner opening being spaced above the furnace floor at substantially the same elevation as the upper end of the air supply pipe and the upper exterior wall of the housing;

means for supplying air in the substantial absence of fuel to the air supply pipe for causing such air to flow upwardly through the air supply pipe past the narrow annular opening and into the enclosed area of the furnace; and gas supply means for supplying gaseous fuel to said hollow interior region for causing such fuel to flow through said burner opening and into the enclosed area of the furnace above the upper end of the air supply pipe and the upper exterior wall of the housing so that the fuel mixes with the air flowing past said burner opening to form a combustible fuel/air mixture, which, when ignited, produces a flame in the furnace adjacent the upper exterior wall of the housing and the upper end of the air supply pipe.

10. Apparatus according to claim 9 in which the flame produced by igniting the combustible fuel/air mixture is produced substantially in the absence of ignition of said fuel in the air supply pipe and in the hollow interior region of the housing.

11. Apparatus according to claim 9 in which the upper end of the housing is separated from the upper end of the air supply pipe substantially by said burner opening, and the air flowing in the air supply pipe is separated from the fuel flowing in said hollow interior region essentially by the wall thickness of the air supply pipe.

12. Apparatus according to claim 9 in which the air supply means includes an air tunnel connected to a source of air under pressure, and means sealing the hollow interior region of the housing against entry of air from said air tunnel into said hollow interior region, said air supply pipe being open to the flow of air under pressure in the air tunnel, and the gas supply means includes a source of gaseous fuel communicating with said hollow interior region and sealed against entry into the air supply pipe.

13. Apparatus according to claim 9 in which the gaseous fuel is at about 15 to 20 psi line pressure.

14. Apparatus according to claim 9 in which the housing includes baffle means adjacent the periphery of the air supply pipe for reducing the cross sectional area through which fuel flows prior to flowing through said burner opening, the baffle means extending over the top of said hollow interior region of the burner.

15. A method for supplying heat to a soaking pit furnace comprising:

supplying air in the substantial absence of fuel to a central conduit of a burner that projects above a floor of a soaking pit furnace for causing such air to flow upwardly through the conduit and above an upper end of the conduit spaced above the floor of the soaking pit furnace;

supplying gaseous fuel to a hollow chamber inside an exterior housing of the burner wherein the exterior housing surrounds the central conduit and has an upper exterior wall spaced above the floor of the furnace, defining the top of the burner, and providing a narrow annular burner opening above the chamber at substantially the same elevation as the upper end of the conduit and the upper exterior wall of the housing, for causing the fuel to flow through the chamber and produce a substantially uniform cross sectional flow of fuel upwardly through the burner opening; and causing the air flowing through the conduit to flow upwardly away from the upper end of the conduit and past the burner opening and draw the surrounding uniform flow of fuel from the burner opening into the passing flow of air to intimately mix the fuel with the air in the furnace adjacent the upper end of the conduit and the upper exterior wall of the housing to produce a combustible fuel/air mixture which, when ignited, produces a flame in the furnace adjacent the upper end of the conduit and the upper exterior wall of the housing.

16. The method according to claim 15 in which the flame is produced in the substantial absence of ignition in the chamber.

17. The method according to claim 15 in which the fuel in the substantial absence of air under pressure is supplied to the hollow chamber.

18. The method according to claim 17 in which the fuel is supplied under about 15 to 20 psi line pressure.

19. The method according to claim 15 in which the fuel is supplied under about 15 to 20 psi line pressure.

20. A soaking pit for heating ingots comprising:

a furnace having an enclosed area above a floor of the furnace;

a burner in the furnace, the burner including a mixing chamber having an inner wall structure surrounding a central region thereof, the inner wall structure having an upper end spaced above the furnace floor, and an exterior housing spaced laterally from and surrounding the inner wall structure to form an annular hollow interior space of relatively larger cross section between the inner wall structure and the exterior housing, the upper end of the inner wall structure being spaced closely apart from an adjacent upper exterior end of the housing to form a narrow elongated annular burner opening of relatively smaller cross section at the top of the furnace above said hollow interior space, the burner opening being spaced above the furnace floor at substantially the same elevation as the upper ends of the inner wall structure and the housing;

gas supply means for forcing a gaseous fuel under pressure to flow through the hollow interior space of the mixing chamber toward said burner opening, said central region of the inner wall structure being in substantial absence of the flow of said fuel under pressure therein; and air supply means for supplying air under pressure to the hollow interior space of the mixing chamber to mix the air with the flow of fuel therein to produce a combustible fuel/air mixture and for causing said mixture to flow out through the burner opening into the enclosed area of the furnace above the upper ends of the inner wall structure and the housing so that said mixture, when ignited, produces a flame in the enclosed area of the furnace adjacent the upper ends of the inner wall structure and the housing, the air supply means including an air tunnel connected to a source of air under pressure, and means sealing said central region of the inner wall structure against entry of air from said air tunnel, said mixing chamber being open to the flow of air under pressure in the air tunnel, and the gas supply means includes a source of fuel under pressure communicating with said mixing chamber and sealed against entry to said central region of the inner wall structure.

21. Apparatus according to claim 20 in which the gaseous fuel is supplied at about 15 to 20 psi line pressure.

* * * * *

UNITED STATES PATENT AND TRADEMARK OFFICE

CERTIFICATE OF CORRECTION

PATENT NO. : 4,411,617

DATED : October 25, 1983

INVENTOR(S) : JOHN MAKSIM, JR.

It is certified that error appears in the above-identified patent and that said Letters Patent is hereby corrected as shown below:

Column 1, line 67, change "it" to --pit-- . Column 3, line 1, change "exceeds" to --extends--. Column 4, line 63, change "introduced" to --introduces--. Column 6, line 11, claim 5, change "air" to --pipe--.

Signed and Sealed this

*Twenty-third* Day of *July 1985*

[SEAL]

*Attest:*

DONALD J. QUIGG

*Attesting Officer* *Acting Commissioner of Patents and Trademarks*